United States Patent [19]

Kobayashi

[11] 3,962,544

[45] June 8, 1976

[54] SOUND REPRODUCING DEVICES

[75] Inventor: Fumio Kobayashi, Hino, Japan

[73] Assignee: Sansui Electric Co., Ltd., Tokyo, Japan

[22] Filed: Dec. 26, 1974

[21] Appl. No.: 536,563

[30] Foreign Application Priority Data

Dec. 28, 1973 Japan ..... 48-2741
Dec. 28, 1973 Japan ..... 48-2742

[52] U.S. Cl. ..... 179/1 E; 181/152
[51] Int. Cl.[2] ..... H04R 1/28
[58] Field of Search ..... 179/1 E; 181/31 A, 152

[56] References Cited

UNITED STATES PATENTS 3,165,587 1/1965 Alderson ..... 179/1 E

FOREIGN PATENTS OR APPLICATIONS 870,882 8/1942 France ..... 181/31 A
1,077,151 10/1954 France ..... 181/31 A

*Primary Examiner*—Kathleen H. Claffy
*Assistant Examiner*—E. S. Kemeny
*Attorney, Agent, or Firm*—Oblon, Fisher, Spivak, McClelland & Maier

[57] ABSTRACT

A sound reproducing device comprising a first (low frequency) speaker and a second (high frequency) speaker, the high frequency speaker mounted within its own housing which allows rear-cone radiation out the housing sides, in addition to front-cone radiation out the front, thereby improving radiation efficiency and transient response.

12 Claims, 9 Drawing Figures

SOUND REPRODUCING DEVICES

BACKGROUND OF THE INVENTION

1. Field of the Invention

This invention relates to a sound reproducing device, and, more particularly, to a speaker device having excellent sound diffusion effects.

2. Description of the Prior Art

In a hi-fi sound reproducing system, a speaker device capable of reproducing sounds substantially over a full range of audio frequencies is used. Such a speaker device usually comprises an enclosure with a buffer board in the front thereof, a woofer mounted in an opening provided in the buffer board for reproducing a relatively low range of audio frequencies, and a speaker similarly mounted in another opening of the buffer board to reproduce midrange and high range audio frequencies.

As is well known the midrange and high range reproducing speakers have a relatively sharp acoustic directivity. Consequently, if such speakers are employed for a stereo sound reproducing system, the stereo sound effects of midrange and high range are greatly reduced if the listners are not on the axes of both the speakers which reproduce midrange and high range audio frequencies.

SUMMARY OF THE INVENTION

It is therefore an object of the invention to provide a new and improved speaker device capable of elimination of the above defect.

Another object of the invention is to provide a speaker device capable of easily reproducing multidimensional sounds of a relatively high range of audio frequencies.

It is a still further object of the invention to provide a speaker device which is able to reproduce sounds of a relatively high range not only in front of the speaker enclosure, but, also, in a direction parallel with the front surface of the speaker enclosure buffer board.

The foregoing and other objects are attained in accordance with one aspect of the present invention through the provision of a speaker enclosure having a buffer board in front thereof. A woofer is mounted on the buffer board to radiate sounds of a relatively low range in front of the buffer board through an opening provided therein. A sound diffuser is mounted on a front surface of the buffer board and includes at least one sound passage therein to diffuse sounds in parallel with the front surface of the buffer board. A cone type speaker which is able to reproduce sounds of a relatively high range is mounted at the center portion of the sound diffuser to connect the rear surface of the speaker cone with the sound passage of the sound diffuser and to open the front surface of the cone in front of the enclosure.

BRIEF DESCRIPTION OF THE DRAWINGS

Various objects, features and attendant advantages of the present invention will be more fully appreciated as the same becomes better understood from the following detailed description of the present invention when considered in connection with the accompanying drawings, in which.

DETAILED DESCRIPTION OF THE PREFERRED EMBODIMENTS

Figure 1:
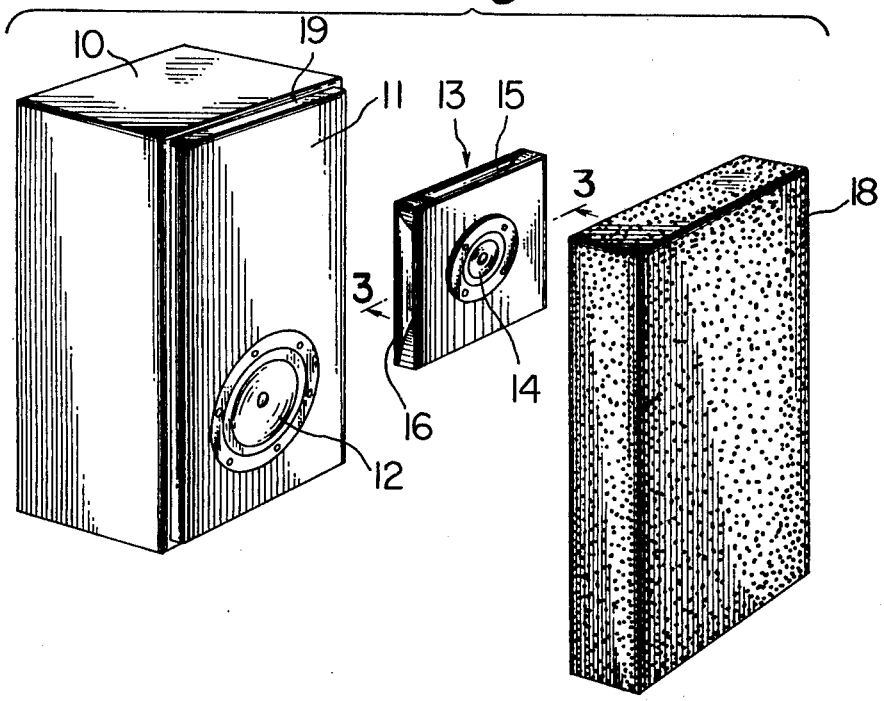
FIG. 1 is a perspective and exploded view of one embodiment of a sound reproducing device in accordance with the invention.

Referring now to the drawings, wherein like reference numerals designate identical or corresponding parts throughout the several views, and more particularly to FIG. 1 thereof, there is shown a speaker enclosure 10 having a buffer board 11 provided in the front thereof. A woofer or low range speaker 12 is mounted in an opening (not shown) of the buffer board 11.

For the convenience of illustration, a diffuser 13 is shown separated from the front surface of buffer board 11, but, in actual use, diffuser 13 is mounted on a front surface of buffer board 11 by means of suitable members such as bolts, nuts, etc. Another speaker 14 which is able to reproduce midrange and high range audio frequencies is mounted at a center portion of diffuser 13. A speaker of this type may be a midrange driver and tweeter. Of course the midrange driver may be separated from the tweeter, and the midrange driver may be mounted on another opening provided in buffer board 11. The speaker 14 capable of reproducing midrange and high range audio frequencies is referred to hereinafter as a relatively high range speaker.

It can be seen that diffuser assembly 13 has a square front section and includes three sound radiation openings 15, 16 and 17. The sound radiation opening 15 opens upwards. Openings 16 and 17 alternately open to opposite sides of the speaker enclosure 10. The opening 17 cannot be seen in FIG. 1, but, is illustrated in a further figure to be described below.

After mounting diffuser 13 on the front surface of buffer board 11, a fancy cover 18 made of a punched metal sheet or cloths of synthetic resins is mounted on an edge 19 of the speaker enclosure 10. The decoration cover 18 takes the appearance of a deep cage so that the cover 18 enables the sounds to radiate not only forward, but also to opposite sides of the speaker enclosure 10.

Figure 2:
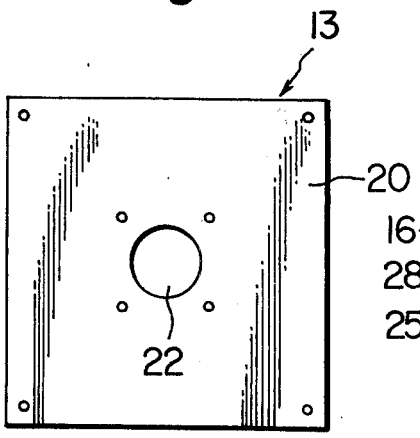
FIG. 2 is a front view showing a front panel of a diffuser of the sound reproducing device.
Figure 3:
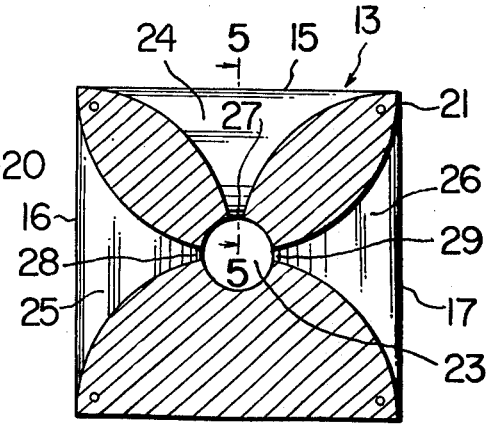
FIG. 3 is a vertical cross section of the diffuser taken along line 3 — 3 of FIG. 1.

Sound diffuser 13 is shown in detail in FIGS. 2 and 3. FIG. 2 shows a front panel 20 of the diffuser 13 removed from the diffuser body 21 shown in FIG. 3. Both front panel 20 and body 21 of diffuser 13 may be made of any suitable material such as, for example, moulded synthetic resins, aluminum die casting, woods and the like. The front panel 20 is provided with a through opening 22 for the convenience of insertion of a rear part of speaker 14 including a driving unit. Similarly the diffuser body 21 has a through opening 23 for receiving the rear part of speaker 14 therein and for introducing lead wires from a voice coil of speaker 14 into the enclosure 10.

The diffuser 13 also includes three sound diffusion passages or exponential sound horns 24, 25 and 26, each of which extends exponentially from throat portions 27, 28 and 29 respectively towards upper opening 15 and side openings 16 and 17. The exponential sound horns 24, 25 and 26 communicate within the through opening 23 through the throat portions 27, 28, and 29, respectively, for the purpose to be described below.

For convenience of illustration, both front panel 20 and diffuser body 21 have been shown as separate pieces, however, they can, of course, be one piece. The latter can be easily made by either a resin moulding process or an aluminum die casting process.

Figure 4:
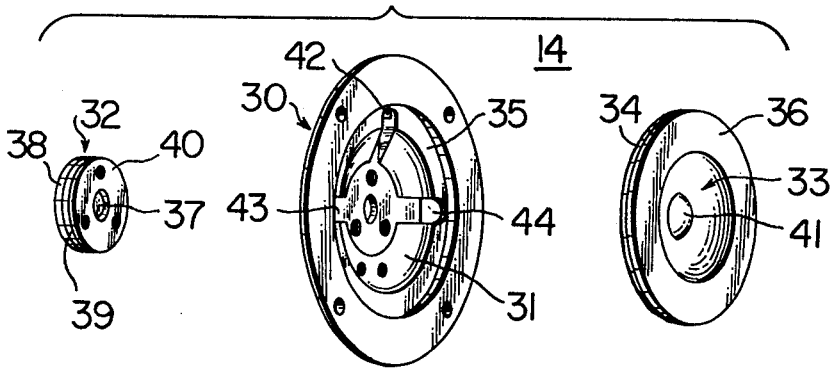
FIG. 4 is a perspective and exploded view of a relatively high range speaker shown in FIG. 1.

FIG. 4 is a perspective, exploded and enlarged view of the midrange and high range speaker 14 shown in FIG. 1. The speaker 14 comprises an aluminum die casted frame 30 having a dish like recessed portion 31, a driving unit or magnet assembly 32 mounted on the rear surface of frame 30, and a speaker cone 33 having an edge portion 34 which adheres to a peripheral portion 35 of the recessed portion 31. To the edge 34 of cone 33 is adhered an annular damper 36 which may be made of any suitable damping material such as a silicone rubber sheet, a resinous paste or the like and which serves to reduce the free vibrations of speaker cone 33 after elimination of the driving forces of the cone 33.

The driving unit or magnet assembly 32 comprises a center pole 37, a circular disk shaped magnetic yoke 38 fitted onto one end of the center pole 37, and an annular permanent magnet 39 interposed between circular shaped magnetic yokes 38 and 40. The front annular yoke 40 has a through opening around the other end of center pole 37. An annular small air gap is provided between an inner wall of the through opening of front yoke 40 and a peripheral portion of the other end of center pole 37 for receiving a voice coil 41 of speaker cone 33 therein to enable it to reciprocate freely along the axis of center pole 37.

It is to be understood that the dish like recessed portion 31 of speaker frame 30 includes three sound holes 42, 43, and 44 each radially extending through the wall of recessed portion 31. In the case that the three components 30, 32 and 33 have been integrally assembled to form a midrange and high range speaker 14, and if the assembled speaker 14 has been mounted on the diffuser 13 such that the driving unit 32 is positioned in the through holes 22 and 23 of the diffuser 13, the rear surface of speaker cone 33 communicates with throat portions 27, 28 and 29 of the exponential horns 24, 25 and 26 through the holes 42, 43 and 44 of the speaker frame 30.

In this way the sounds radiated from the rear surface of speaker cone 33 will go through holes 42, 43 and 44 respectively into the exponential horns 24, 25 and 26, and then the sounds are radiated from the vertical horn 24 upwards. Similarly, the sounds are radiated from the horizontal horns 25 and 26 leftwards and rightwards. It is to be understood that the sound radiations as described above are made substantially in a plane parallel with the front surface of buffer board 11. It is to be further understood that the sound radiation is effected from the front surface of speaker cone 33 in the front of speaker enclosure 10. In this way, in accordance with the speaker device described above, it is possible to easily diffuse the reproduced sounds of midrange and high range over a considerably wider area. This is a great benefit in realizing realistic stereo sound.

It is also to be understood that the front panel or decoration panel 18 is expanded in the front thereof and the edge portions, namely, the upper edge and both side edges, to enable the reproduced sounds to easily pass therethrough. Thus, the presence of panel 18 does not hinder the reproduced sounds which are diffused in parallel with the front surface of buffer board 11.

Figure 5:
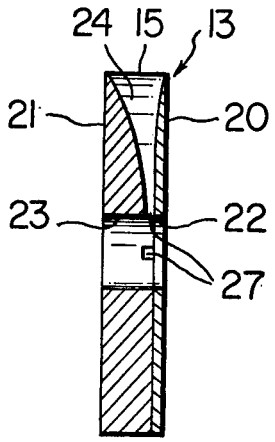
FIG. 5 is an elevational cross section of the diffuser taken along line 5 — 5 of FIG. 3.

FIG. 5 is a cross section of FIG. 3 which illustrates a side view of the exponential horn or sound diffusion passage 24 formed in the diffuser assembly 13. The side views of exponential sound horns 25 and 26 are substantially similar to that of the horn 24. As is shown in FIG. 5, the opposite inner walls of diffuser body 21 and the front panel 20 thereof are machined to form smoothly curved surfaces for the exponential horn 24.

Thus, the sound diffusion effects of midrange and high range audio frequencies can be greatly elevated by the exponential horns 24, 25 and 26 of the sound reproducing device in accordance with the invention.

Figure 6:
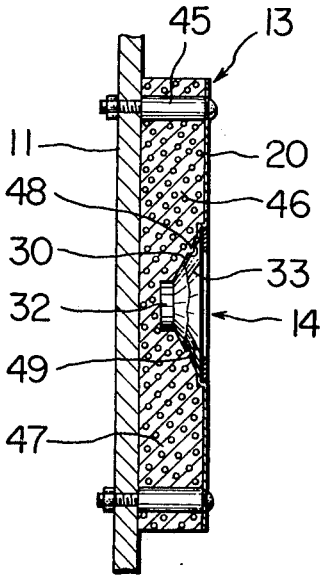
FIG. 6 is a vertical cross section, partially broken away, of another embodiment of a diffuser assembly in accordance with the invention.

FIG. 6 shows another embodiment of the invention in which a diffuser assembly 13 is composed of a buffer board 11 and a front panel 20 which is positioned in front of buffer board 11 and separated therefrom. The front panel 20 is also supported on the buffer board 11 by means of several tubular spacing rods 45 which are interposed between panel 20 and buffer board 11, and which extend therethrough to fasten the front panel 20 to the buffer board 11.

As is shown, a speaker frame 30 is formed integrally with the front panel 20 by pressing a sheet of metal out. A speaker cone 33 and a driving unit 32 are then mounted on the speaker frame 30 as usual.

In this way a high range speaker 14 is assembled in diffuser 13. With this embodiment, a sound diffusion passage 46 is further provided around the speaker frame 30 in the space between buffer board 11 and front panel 20. The space or sound diffusion passage 46 between panel 20 and buffer board 11 is filled with a sound dispersion member 40, for example, sponge rubber, bubbled polystyrene, glass wool or the like.

The speaker frame 30 has through openings 48 and 49 to the sound diffusion passage 46 to freely diffuse the sounds reproduced at the rear surface of the speaker cone through the passage 46 upwards, downwards, rightwards and leftwards. In sound diffusion passage 46, the reproduced sounds are effectively dispersed by the presence of sound dispersion member 47 to elevate the sound diffusion effect. At the same time, the sound dispersion on member 47 causes the speaker cone to be effectively mechanically damped. Because of this, the material of sound dispersion member 47 is selected from a group which is adapted for the reproducing frequency range of the speaker 14.

Also, in accordance with this embodiment, it is possible to assemble the sound diffuser 13 more easily than that of FIGS. 1 to 3 so that the speaker device can be priced lower.

Figure 7:
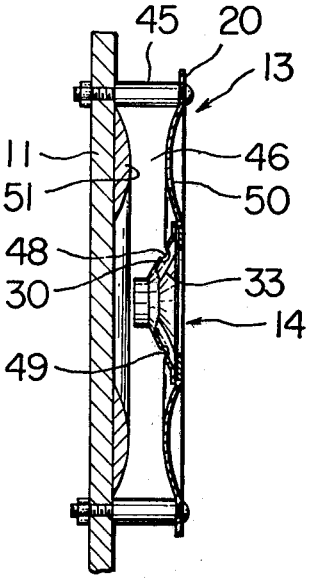
FIG. 7 is a vertical cross section, partially broken away, of a further embodiment of a diffuser assembly in accordance with the invention.

FIG. 7 shows a further embodiment of a diffuser 13. In accordance with this embodiment, a speaker frame 30 of a high range speaker 14 is formed integrally with the front panel 20 of a sound diffuser assembly 13 in a manner similar to that of FIG. 6. The front panel 20 is made of a sheet of metal and includes an annular recessed portion 50 around the speaker 14. An annular member 51 has a configuration similar to that of the front panel 20 except that the speaker part is provided at the front surface of buffer board 11 by having the axis thereof coincide with that of annular recess 50.

In this way, a sound radiation passage or sound diffusion passage 46 is formed between the front panel 20 and the annular member 51 all around the speaker frame 30 in a manner similar to that of FIG. 6. The sound radiation passage 46 communicates with the speaker cone 33 through the holes 48 and 49 provided through the speaker frame 30. Thus, the sounds reproduced at the rear surface of speaker cone 33 are radiated through the sound radiation passage 46 in parallel with the front surface of buffer board 11. At the same time, a mechanical damping function to the speaker cone 33 suppresses its natural vibrations by the presence of a narrow throat portion or space of passage 46 between the front panel 20 and the annular member 51.

Figure 8:
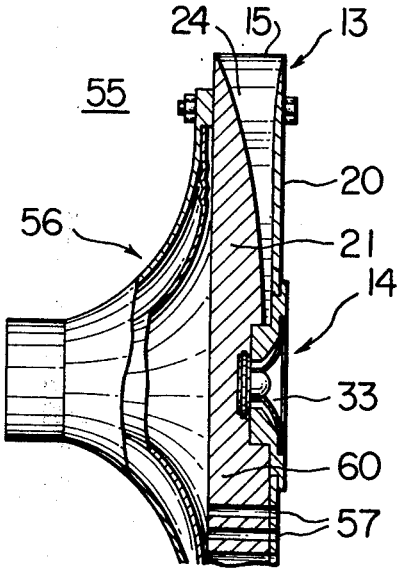
FIG. 8 is a vertical cross section, partially broken away, of a still further embodiment of a diffuser assembly in accordance with the invention.

In FIG. 8 is shown a compound type speaker device in accordance with a still further embodiment of the invention designated by reference numeral 55. For convenience of illustration, the compound speaker device 55 is illustrated as a co-axial type. However, of course, the present invention is not limited to this type. It is to be understood that a high range speaker or tweeter 14 can be provided at an off-center position to a woofer 56 which reproduces relatively low range audio frequencies.

The diffuser assembly 13 is formed substantially in a manner similar to that to FIGS. 1 to 3 with the exception of the following.

The woofer 56 is mounted on a rear wall of the diffuser 13 and the latter is in turn mounted on the front wall of the buffer board 11 as shown in FIG. 1. A through opening with a large diameter should be provided through the buffer board 11 for enabling the woofer 56 to be inserted into the speaker enclosure 10 through the opening from the front part of the buffer board 11 to the rear. After insertion of the woofer, the diffuser assembly 13 is fixed to the front surface of buffer board 11 to accompany the woofer 56.

Figure 9:
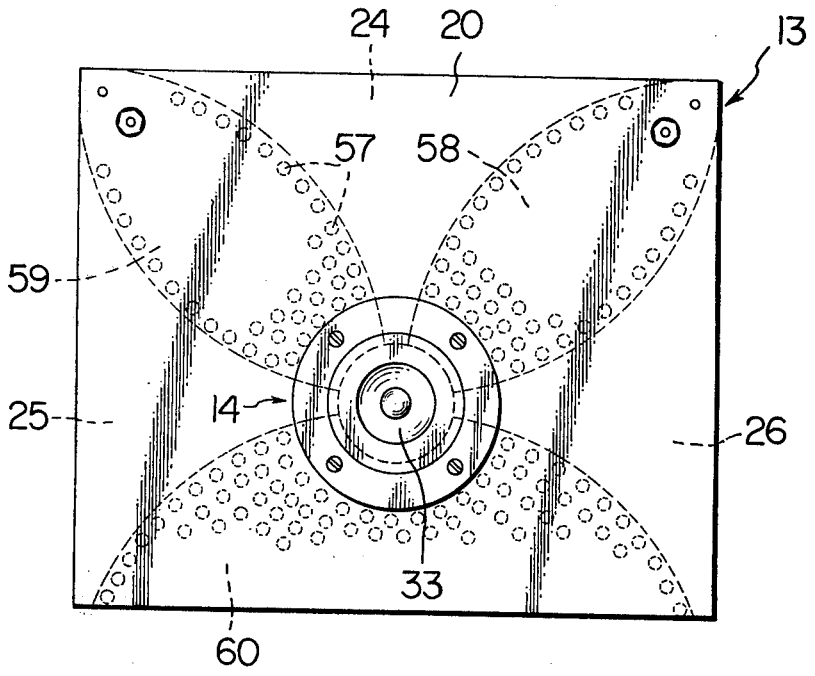
FIG. 9 is a front view of the diffuser assembly of FIG. 8.

As shown in FIGS. 8 and 9, many through openings 57 are provided extending from the rear to the front part of the diffuser 13 through solid body portions 58, 59 and 60, each positioned between adjacent sound radiation horns 24, 25 and 26 of the diffuser assembly 13. It should be understood that the configuration of the through openings 57 is not limited to the circular form, but can be rectangular, oval, etc.

The sounds reproduced by the co-axial woofer 59 which are relatively low range audio frequencies pass freely through the openings 57 of diffuser 13 from the rear to the front thereof. The sounds reproduced by the rear surface of tweeter cone 33 go upwards and to opposite sides through sound radiation horns 24, 25 and 26 in the diffuser 13. The sounds reproduced by the front surface of the same cone 33 radiate in front of the speaker enclosure 10. Accordingly, it is possible to diffuse the sounds reproduced by the tweeter or mid-range and high range speaker 14 extensively over a wide angle. This is of great benefit in producing a realistic stereo sound.

Obviously, numerous modifications and variations of the present invention are possible in light of the above teachings. It is therefore to be understood that within the scope of the appended claims the invention may be practiced otherwise than as specifically described herein.

What is claimed as new and desired to be secured by Letters Patent of the United States is:

1. A sound reproducing device comprising:

a speaker enclosure with a buffer board disposed in front thereof for mounting a speaker device thereon, a first speaker device enclosed in said enclosure and mounted on said buffer board to reproduce relatively low range audio frequencies, a second speaker device mounted on said buffer board to reproduce relatively high range audio frequencies, a diffuser assembly mounted on a front surface of said buffer board and provided with at least one sound radiation passage therein substantially in parallel with a front surface of said buffer board, said diffuser assembly being provided with said second speaker device mounted thereon in front thereof, and said second speaker device comprising a speaker cone, a front surface of which is disposed in front of said speaker enclosure to radiate the sounds reproduced there forward, and a rear surface of which communicates with said sound radiation passage in said diffuser assembly to radiate the sounds reproduced there substantially in parallel with the front surface of the buffer board.

2. A sound reproducing device according to claim 1 wherein said diffuser assembly mounted on a front surface of said buffer board comprises a body member mounted on a front surface of said buffer board having exponential sound radiation horns one of which opens upward and two of which open toward opposite sides thereof, a front panel for forming said exponential sound horns to cooperate with the body, a relatively high range speaker having a speaker frame mounted in an opening provided at a center location of said diffuser front panel, said speaker frame having through openings connecting a rear surface of the speaker cone with throat portions of said exponential sound passages, whereby the sounds reproduced at the rear surface of said speaker cone are diffused substantially in parallel with the front surface of said buffer board upwards and to opposite sides thereof through said exponential sound radiation horns.

3. A sound reproducing device according to claim 2, wherein said diffuser body and its front panel are made of a wood material.

4. A sound reproducing device according to claim 2 wherein said diffuser body and its front panel are integrally made of an aluminum die casting.

5. A sound reproducing device according to claim 2, wherein said diffuser body and its front panel are integrally made of a moulded resin.

6. A sound reproducing device according to claim 1, wherein said speaker enclosure has a decoration cover member mounted around the front edges thereof, said cover being formed to be a relatively deep cage and being made of a punched sheet of metal, whereby the sounds emanating from said diffuser are able to pass freely through an upper portion and both sides of the decoration cover.

7. A sound reproducing device according to claim 1, wherein said speaker enclosure has a decoration cover member mounted around the front edges thereof, said cover being formed to be a relatively deep cage and being made of cloths of synthetic resins having a high sound transparency, whereby the sounds coming from said diffuser are able to pass through an upper portion and both sides of the decoration cover member.

8. A sound reproducing device according to claim 1, wherein said diffuser assembly is composed of said buffer board and a front panel separated from and in front of the buffer board by spacer members, said relatively high range speaker is mounted on said front panel so as to open a front surface of said speaker cone forwards and to connect a rear surface of the cone to a space between said buffer board and said front panel so that a sound radiation passage is formed around the speaker in said space.

9. A sound reproducing device according to claim 8, wherein said sound radiation passage around said relatively high range speaker is filled with a porous substance for dispersing the sounds reproduced at a rear surface of the speaker cone and for mechanical damping the speaker cone.

10. A sound reproducing device according to claim 8, wherein said front panel is made of a sheet member which is integral with a speaker frame of said relatively high range speaker.

11. A sound reproducing device according to claim 8, wherein said panel is made of a sheet member and is provided with a relatively high range speaker mounted thereon at a relatively center location thereof, said panel being deformed to form an annular recessed portion around said speaker, and an annular member is mounted on a front surface of said buffer board so as to face its projected surface with the bottom of said annular recessed portion so that a sound radiation passage is formed around the speaker between said buffer board and said front panel to define a narrow passage which mechanically damps the speaker cone.

12. A sound reproducing device according to claim 1, wherein said sound diffuser assembly includes a relatively high range speaker mounted on a center position thereof so as to be able to radiate the reproduced sounds forwards, said sound diffuser being also provided with sound radiation passages therein one of which extends from said center position to open upwards and others of which extend from said center position to open rightwards and leftwards respectively, each of said sound radiation passages having a throat portion located at said center position to communicate with a rear surface of said speaker cone, said sound diffuser assembly further comprising a woofer mounted on a rear side thereof, said diffuser assembly being provided with through openings from the rear to the front part thereof for conducting the sounds reproduced by the woofer in front of the diffuser, and said through openings being positioned in solid body portions of the diffuser where said sound radiation passages are not provided.

* * * * *